US005575724A

United States Patent [19]

Hannon et al.

[11] Patent Number: 5,575,724

[45] Date of Patent: Nov. 19, 1996

[54] ALIGNMENT-ORIENTED GOLF CLUB

[75] Inventors: Richard H. Hannon, Oceanside; Carl T. Wagner, Encinitas, both of Calif.

[73] Assignee: Golfology, Inc., Carlsbad, Calif.

[21] Appl. No.: 504,124

[22] Filed: Jul. 19, 1995

[51] Int. Cl.[6] ..... A63B 53/14

[52] U.S. Cl. ..... 473/315; 473/303

[58] Field of Search ..... 473/287, 288, 473/296, 298, 299, 300, 302, 303, 305, 306, 307, 308, 309, 310, 313, 314, 315, 316

[56] References Cited

U.S. PATENT DOCUMENTS

| | | | |
|---|---|---|---|
| 1,426,202 | 8/1922 | Lard | 473/315 |
| 1,524,322 | 1/1925 | Stolley | 473/315 |
| 1,895,417 | 1/1933 | Lard | 473/315 |
| 2,018,723 | 10/1935 | Hutchison | 473/315 |
| 2,103,889 | 12/1937 | Brisick | 473/303 |
| 2,150,737 | 3/1939 | Chittick | 473/315 |
| 2,993,695 | 7/1961 | Birch et al. | 473/315 |
| 4,116,440 | 9/1978 | Takashima . | |
| 4,186,924 | 2/1980 | Southey . | |
| 4,629,191 | 12/1986 | Mancuso . | |
| 5,042,804 | 8/1991 | Uke . | |
| 5,217,380 | 6/1993 | Martinet | 434/252 |
| 5,460,372 | 10/1995 | Cook | 473/303 |
| 5,478,074 | 12/1995 | Storper | 473/302 |

*Primary Examiner*—Steven Wong
*Attorney, Agent, or Firm*—Frank G. Morkunas

[57] ABSTRACT

An improved golf club having pre-structured alignments between shaft, grip, and head. This structure encompasses a plurality of sides between shaft, grip, and head. One such side is an impact-alignment surface and is on a single plane between shaft, grip, and head. Another side is a target-alignment surface which is on another single plane between shaft, grip, and head. The impact-alignment surface is perpendicular to a striking face of the golf club and to the target-alignment surface. The golf club also has a mounting structure for mounting grip and head to shaft which accurately registers the respective aforesaid alignment surfaces. The mounting structure comprises mating sides between shaft, grip, and head; or cooperating depressions and projections on shaft, grip, and head.

15 Claims, 3 Drawing Sheets

ALIGNMENT-ORIENTED GOLF CLUB

BACKGROUND OF THE INVENTION

This invention relates to golf clubs, more specifically to comprehensive alignments between shaft, grip, and head; and in particular to a golf putter.

Golf putters basically consist of a shaft having a butt and a tip, a head on the tip of the shaft, and a grip inserted over the butt of the shaft. The head has a connector which accepts the shaft and connects the head to the shaft. On the head, distal in relation to the shaft, is a toe. Also on the head is a heel which is proximal in relation to the shaft. A face lies in between the heel and toe. That portion of the face which strokes the ball is the striking face.

Approximately 40–60% of all golf play occurs on the green and involves the use of a golf putter. Consequently, putting is a major and critical part of the game. There are three basic putting styles; (1) the pendulum stroke, (2) the cocked-wrist stroke, and (3) the wrist strike. The first two are the most common and used by the vast majority of golfers; amateur and professional alike. Each of the two common styles use the shoulders as the focal point and force behind the stroke. The arms, wrists, and hands are, and remain locked, throughout the stroke. The ball is "pushed" rather than struck. The stroke must be smooth, fluid, and un-interrupted, free of twitch (jerky stroke) and hesitation (minute disruptions to the stroke). On a vertical plane, the putter head should not pass beyond the golfer's hands. The wrists in particular should remain locked in position as any movement in the wrists is magnified in reaction at the putter head. The only difference between these two styles is the hand-wrist positions and shaft alignment with respect to the shoulders. In the pendulum style, the arms from the shoulders downward form a "V"; the wrists are in line with the arms. The shaft of the golf putter substantially bisects the "V" and is in substantial straight-line alignment from the putter head to the shoulders. By this alignment, the shaft becomes a long lever artificially extended from butt-end of the shaft to the focal point of the stroke. The shoulders as the fulcrum push the stroke through to the ball.

In the wrist-cock style, the arms at the elbows are straight, but the wrists and hands are locked in a slightly cocked position. The shaft of the golf putter is thereby slightly angled in relation to the bisection point of the "V" described above. In this style, the shoulder also acts as the focal point and fulcrum to push the stroke through to the ball. The wrists should remain locked in their cocked position. As with the pendulum style, the arms, in locked fashion, move in tandem with the shoulders. The hands attempt to hold the golf putter steady for the duration of the stroke.

The last style is the least used; mostly by beginners. In this style, the wrists rather than the shoulders provide the driving force to swing rather than to stroke the golf putter. The wrists unlock and become the pivot point of the swing. The ball is struck rather than stroked and, on a vertical plane, the putter head swings past the hands. In all styles, alignment between grip, shaft, and head; between golfer and putter; between putter and ball; and between ball and hole is, without question, paramount to a successful putt.

Putting entails the unity of physical and mental attributes which, much like links in a chain, where one is deficient, the unity is adversely affected. Mastering the art of putting projects a golfer into a higher caliber of play. The best putt is one in which the stroke is smooth, fluid, un-interrupted, free of twitch and hesitation, is dead square with the immediate target (the ball) and is square to and in 'Target-Alignment' with the ultimate target (the hole). It encompasses a dynamic interplay between golfer (mental and physical), putter, ball (immediate target), topography, and hole (ultimate target). This is what is referred to as 'Dynamic-Alignment'. Without every aspect of dynamic-alignment in proper play, the putting game suffers.

The first aspect of dynamic-alignment is 'Physical-Alignment'. The concern here is for a proper union between golfer and putter such that the hand-to-putter relation is 'dead flat'; i.e., the manner of gripping the putter. The dead-flat grip is where the thumbs are on top of the golf grip such that if a single straight line extended away from the sides of the thumb, that imaginary line would be perpendicular with the striking face of the putter head. Palms are on the sides of the golf grip such that similar imaginary lines extending outward therefrom would be parallel to striking face of the putter head.

The next aspect of dynamic alignment is 'Impact-Alignment'. The concern here is on the putter and its immediate target (the ball) such that the putter-to-ball relation is 'dead square'; i.e., how the putter striking face strikes the ball. Being dead-square with the ball means the golfer must ensure that only the longitudinal center of the striking face impacts the ball, that the striking face is perpendicular to a target line, that the imaginary lines projected by the thumbs in a 'dead flat' grip is parallel to the target line, and that the ball (as longitudinally centered on the striking face) is between the target line and the striking face. Impact-alignment involves all elements of a putter (manner of gripping, grip, shaft, head, striking face, ball, and target line) as they relate to a ball before impact. It is by far the most critical aspect of dynamic-alignment and the primary, but not only, focus of this invention.

The final aspect of dynamic-alignment is target-alignment. In target-alignment the emphasis is on the ultimate target (the hole) and the ball. The interplay in this alignment relationship also entails to a great extent impact-alignment. To execute the very best putt possible, the golfer must ensure that he properly grips the club, that he is 'dead square with the ball', and that he is square on target. Optimum end-results are achieved when physical-alignment, impact-alignment, and target-alignment are in perfect harmony. Thus, dynamic-alignment is fully realized. A golfer who enjoys the totality of such an alignment, will play a markedly improved golf game. Anything less in any alignment process undermines dynamic-alignment. A putter, the structure of which augments a golfer's manual attempts at achieving dynamic-alignment, is a technological break-through in the unquestionably crowded art of golf.

The game of golf is a difficult, physically and mentally demanding, game. Though some have devised clubs and putters which have some alignment-oriented characteristics, none have had the vision which the present invention incorporates. Circular or substantially rounded grips, shafts, and connectors on heads, in any combination, make the realization of dynamic-alignment extremely difficult if not impossible. First, in assembling such clubs and putters, the assembler must individually ensure impact-alignment, the most critical aspect of dynamic-alignment, is attained with each club or putter assembled. This important phase to club fitting has a great potential, albeit unintentional, to undermine dynamic-alignment. Second, even if impact-alignment is achieved in an assembly, any portion of a club or putter which is rounded or substantially circular tends to nurture a false perception in the alignment process where it counts most; in play. A golfer must visualize a parallel or a perpendicular relationship to the target, the ball, and the striking face while using rounded or substantially circular reference points (i.e., the grip, shaft, and head of a club or putter). A difficult task, even for the professional, and one which tends to further undermine dynamic-alignment. And finally, the feel when hand and grip are in union must be perfect and impact-alignment oriented. Each of these adverse potentials, when combined, compound the adverse affects and vitiate dynamic-alignment.

Any slight edge for a golfer, particularly in the critical alignment processes, results in a major advantage in play. Similarly, any improvement over the prior art which accords an edge to a golfer is a significant improvement over the prior art. Golf is an undeniably popular sport. Millions play regularly and routinely attempt to improve their game. Many attempt to improve the quality of the clubs with which they play so that they, and others like them, may play better.

Many modifications to clubs and putters have been made and patented in the past. All such enhancements to the implements of the game strive to achieve a better play for the golfer. Some attempts to improve club structure include Mancuso's 'Golf Club Including Pentagonal Grip', U.S. Pat. No. 4,629,191; Southey's 'Arthritic Golf Club Grip', U.S. Pat. No. 4,186,926; and Takeshima's 'Golf Club Grip', U.S. Pat. No. 4,116,440. Also related is Martinet's 'Method of Teaching the Positioning of a Golfer's Hands on a Golf Club', U.S. Pat. No. 5,217,380; and, to a lesser degree, Uke's 'Hand Grip for Sporting Equipment or Tools', U.S. Pat. No. 5,042,804.

Mancuso discloses a pentagonal grip having a flat upper surface (impact-alignment surface) with all other flat surfaces off-angle to critical moments of play, in particular to impact-alignment. Consequently, such a grip distorts impact-alignment and dynamic-alignment rather than enhances them. The inner chamber of the grip is circular suited for a circular shaft. In addition to distorting dynamic-alignment, it fails to address mounting-alignment. The sole purpose of Mancuso's invention is to aid a golfer in properly positioning his hands on clubs.

Southey's grip is also suited for circular shafts whereas the chamber of the grip is substantially rectangular with one arcuate surface. When the grip is inserted over the circular shaft, four longitudinal rounded projections appear on the outer surface of the grip. These projections aid in gripping a club; they do nothing for dynamic-alignment, impact-alignment, or mounting-alignment.

Takeshima discloses a grip with multiple surfaces, all but one of which are flat surfaces—the upper surface. The upper, impact-alignment, surface is arched. The grip is suited for circular shafts. Like the aforementioned devices, this invention is not suited to dynamic-alignment, impact-alignment, or mounting-alignment.

Martinet discloses a teaching method which incorporates the use of a grip having multiple outer flat surfaces. The surfaces generally range in number from 5 to 9. As a learner progresses, grips with more surfaces are used until the learner can adequately handle round-surface grip. This grip is suited for circular shafts. The grip may also have multiple inner flat surfaces. But in this configuration, the outer surface is circular. In no event are the inner and outer surfaces reciprocally flat. Martinet is not structured for dynamic-alignment, impact-alignment, or mounting-alignment.

Uke discloses a grip having multiple inner and reciprocal outer flat surfaces—generally octagonal. The inner surfaces have cushions to provide softness to the handle. The grip device is suited for high-impact force absorption. Though it has flat inner and outer surfaces, it is neither impact-alignment nor mounting-alignment structured.

None of the prior art devices take into account totality of alignment imperative to golf and primarily to putting. None have been able to augment the manual execution of dynamic-alignment. They have focused primarily on limited or isolated aspects of the game. They did not relate to the comprehensive nature and associated interplay of the game. The present invention, with its focus on impact-alignment through manufacture, play, follow-on repairs, and after-market add-ons achieves that which was missing in the prior art. Not only does the present invention, with its structure and mounting-alignment means definitively establish impact-alignment and augment dynamic-alignment at the outset, such configurations facilitate the assembly of clubs and putters and any after-market changes without affecting factory-tuned impact-alignment. Many golf pro shops assemble clubs and putters on the premises. It is a simple process whereby a tip is mounted, aligned, and fixed to a shaft and a grip is mounted and aligned on that shaft. What is not simple is realizing an accurate, consistent mounting alignment in the assembly process. Mounting-alignment is also critical to play. Deviations in mounting-alignment which could alter actual or perceived, impact-alignment undermines dynamic-alignment and, consequently, would adversely affect the play. Painstaking measures are employed to ensure that mounting-alignment is accurate. These steps are repeated over and over. As with all manual repetitions, deviations result. These deviations ultimately affect the play of the game.

The present invention not only augments impact-alignment in play, but also in assembly. All elements of this invention are precision-tuned once. Once proper alignments are attained on each element, the elements are manufactured and distributed for final assembly. The features of this invention make the assembly process no more difficult than inserting a matching glove onto a mating hand—merely slip the pieces together. All the elements have been pre-aligned with impact-alignment pre-eminent in the process. Once attained at the outset, mounting-alignment, physical-alignment, impact-alignment, target-alignment, and dynamic-alignment follow. The enhancements of the present invention augments dynamic-alignment and facilitates assembly, modification, and repair.

SUMMARY OF THE INVENTION

The above-noted problems, and others, are overcome by the improved golf putter which comprises a grip having an outer grip surface, said grip further having an impact-alignment surface and a target-alignment surface; a shaft having a butt and a tip; a head having a striking face, said head further having an impact-alignment and a target-alignment surface; mounting-alignment means carried by said grip, said head, and said shaft for only allowing registration of respective impact-alignment and target-alignment surfaces; and attachment means for attaching said grip and said head to said shaft.

The present invention, with its unique mounting-alignment means, definitively establishes impact-alignment and augments dynamic-alignment at the outset. The grip, the shaft, and the head can be assembled to attain the various operational alignments only when, during assembly, they are aligned by the mounting means. Such configurations also facilitate assembly and any after-market changes without affecting factory-tuned impact-alignment and mounting-alignment. Head and grip are easily and accurately fitted onto a shaft in a comprehensive operational relationship. This relationship better enables a more accurate playing grip by a golfer and materially enhances dynamic-alignment between a golfer, the club, the striking face, the ball, and the ultimate target.

The essence of this invention is suited for all types of sports implements which require accuracy in mounting and in play and is not limited in scope to golf clubs.

Accordingly, several objects and advantages of our invention are to:

augment dynamic-alignment;

improve the visual aspects of alignment when putting;

improve the mental aspects associated with putting alignments;

improve the physical aspects associated with putting alignments;

improve the feel and grip associated with grasping and stroking a putt;

ensure that impact-alignment is attained and maintained when putting, when assembling this putter, when repairing this putter, and when placing after-market parts on this putter; and improve the general mechanics of a putting stroke.

Other objects and features of the invention will become apparent as the drawings which follow are understood by reading the corresponding description thereof.

BRIEF DESCRIPTION OF THE DRAWING FIGURES

Figure 1:
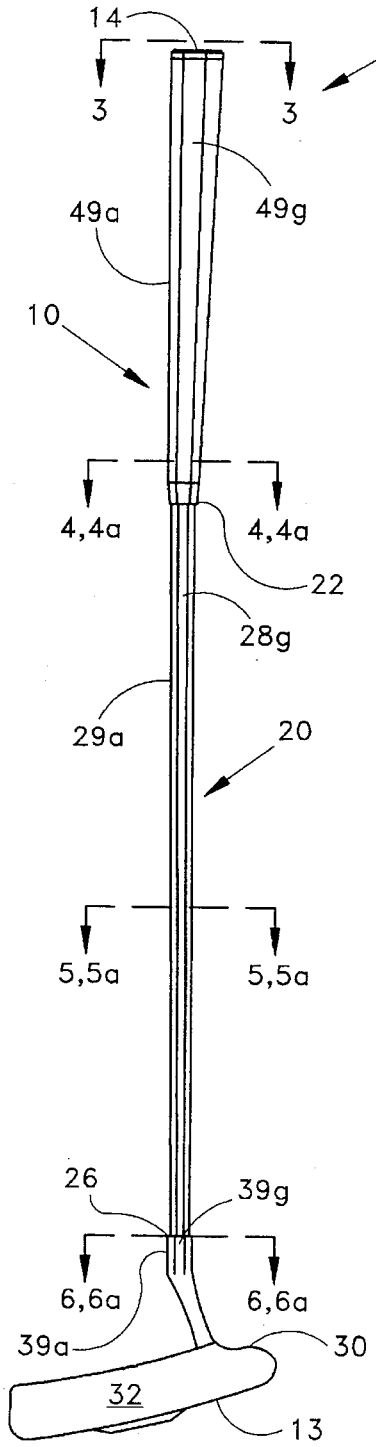
FIG. 1 is an elevation side view of a golf club.
Figure 4:
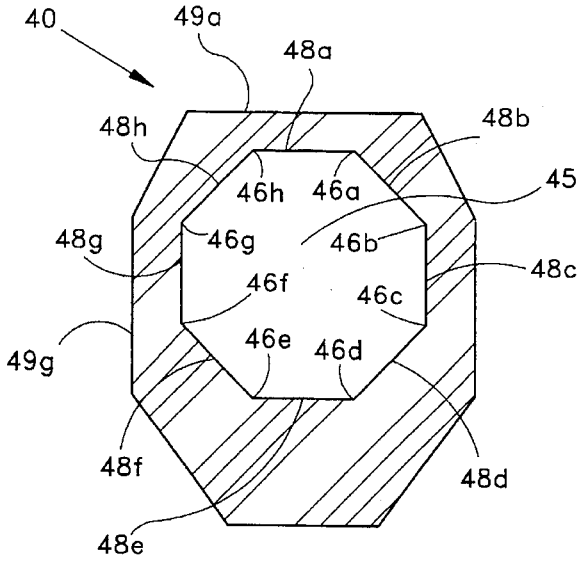
FIG. 4 is a section view of the golf club taken at line 4—4 of FIG. 1.
Figure 4A:
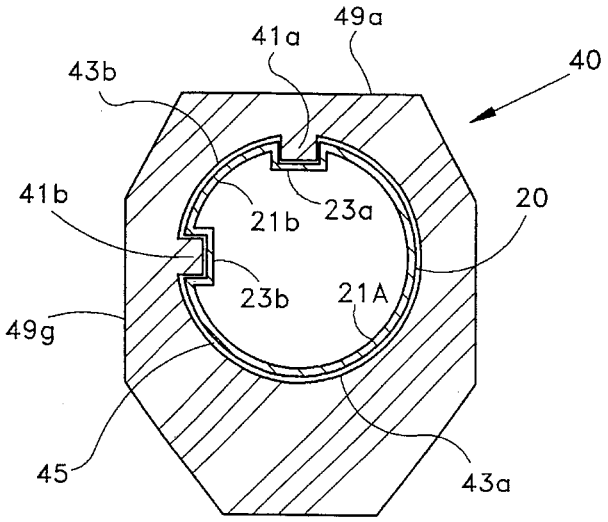

FIG. 4*a* is a section view of the golf club taken at line 4*a*—4*a* of FIG. 1.

Figure 5:
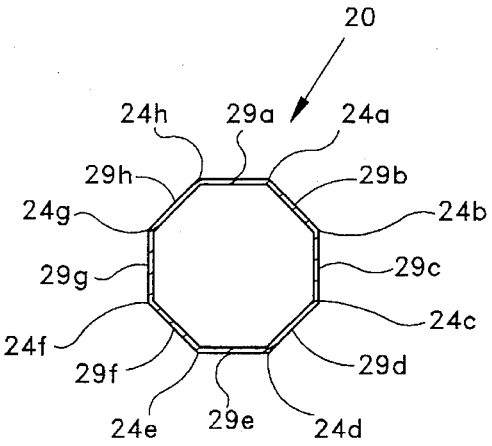

FIG. 5 is a section view of the golf club taken at line 5—5 of FIG. 1.

Figure 5A:
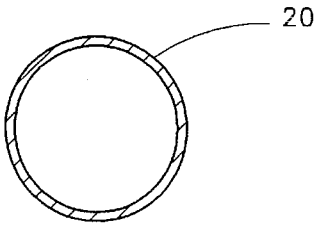

FIG. 5*a* is a section view of the golf club taken at line 5*a*—5*a* of FIG. 1.

Figure 6:
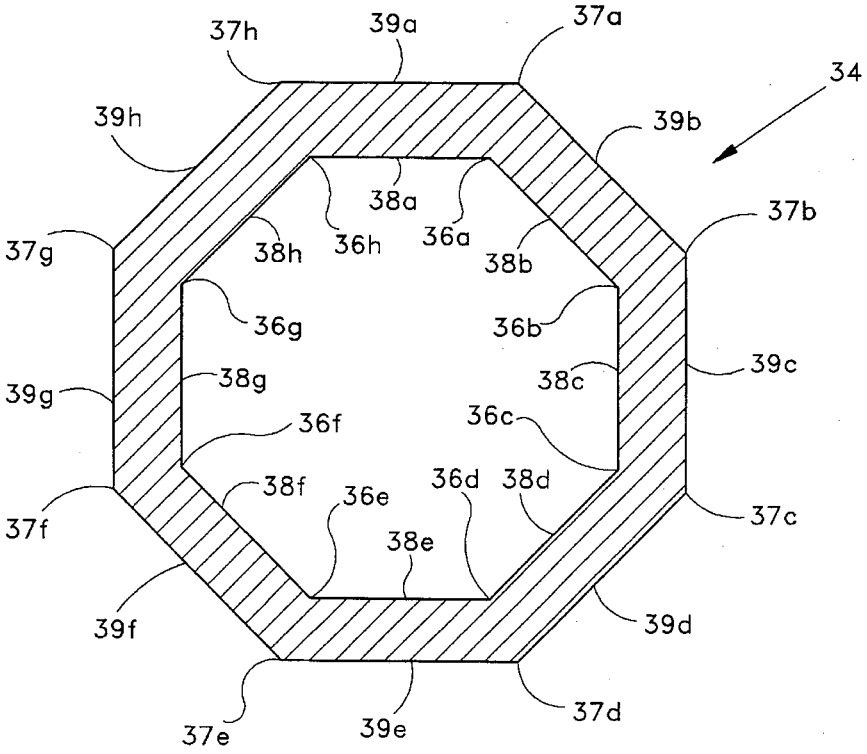

FIG. 6 is a section view of the golf club taken at line 6—6 of FIG. 1.

Figure 6A:
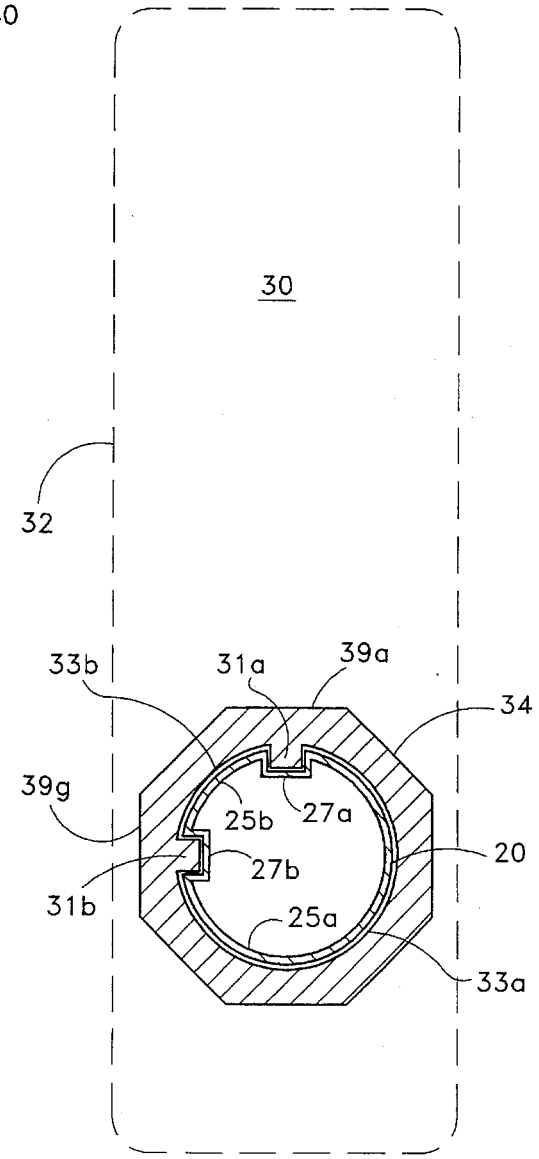

FIG. 6*a* is a section view of the golf club taken at line 6*a*—6*a* of FIG. 1.

DETAILED DESCRIPTION OF THE PREFERRED EMBODIMENTS

FIG. 1 is an elevation side view of a golf club and, for clarity, neither it nor the other figures are to scale. It reveals putter 10 with top 14, bottom 13, shaft 20, head 30, and grip 40. Shaft 10 has butt 22, tip 26, and clearly defined substantially flat longitudinal shaft sides with first shaft side 29*a* being an impact-alignment surface and second shaft side 29*g* being a target-alignment surface. Head 30 has striking face 32 and connector 34. Connector 34 receives tip 26 and thereby connects shaft 20 and head 30. Connector 34 has clearly defined connector sides (see also FIG. 6). First connector side 39*a* is an impact-alignment surface and second connector side 39*g* is a target-alignment surface. Grip 40 inserts onto shaft up to butt 22 thereby connecting shaft 20 and grip 40. Grip 40 has outer grip surface 49 with a plurality of grip sides 49*a*–*h* thereon. First grip side 49*a* is an impact-alignment surface and second grip side 49*g* is a target-alignment surface (FIG. 5 provides greater clarity of grip sides and corners).

A conventional attachment means may be used to connect head 30 and grip 40 to shaft 20. Such means include, but is not limited to, friction-fit, adhesives (such as tape and epoxy), shims, and other means suitable for the intended purpose. Shaft 20 can be substantially parallel or substantially tapered. It can be configured to fit into a head connector, into a hosel, or over a hosel.

FIG. 1 also shows the alignment of all impact-alignment surfaces 49*a* (first grip side), 29*a* (first shaft side), and 39*a* (first connector side) being along a single plane and in substantial perpendicular relationship to striking face 32.

Figure 2:
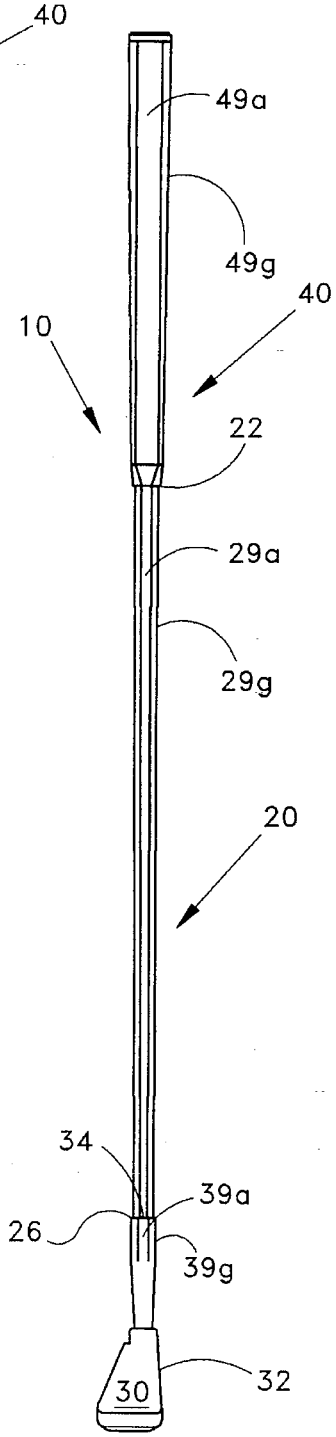
FIG. 2 is an elevation front view of a golf club.

FIG. 2 shows the alignment of all target-alignment surfaces 49*g* (second grip side), 29*g* (second shaft side), and 39*g*(second connector side) being along a single plane and in substantial parallel relationship with striking face 32. The arrow shows the striking direction of putter 10 to a ball (not shown).

Figure 3:
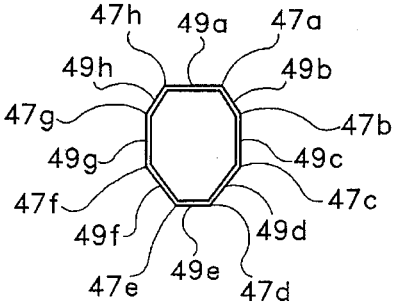
FIG. 3 is a section view of the golf club taken at line 3—3 of FIG. 1.

FIG. 3 is a cross-section view taken at line 3—3 of FIG. 1. It shows grip sides 49*a*–49*h* and outer grip corners 47*a*–47*h*.

FIG. 4 is a cross-section view taken at line 4—4 of FIG. 1 (shaft 20 not shown for ease of explanation) showing grip 40 and chamber 45. This, and all cross-section views, reveal the structure of the putter which facilitates proper registration of respective alignment surfaces. In this Figure, chamber 45 has eight substantially flat longitudinal chamber sides 48*a*–48*h* therein and eight substantially equiangular chamber corners 46*a*–46*h* therebetween. First chamber side 48*a* is an impact-alignment surface and second chamber side 48*g* is a target-alignment surface. First chamber side 48*a* in on the same side and parallel to first grip side 49*a*; each being impact-alignment surfaces.

FIG. 5 is a cross-section view taken at line 5—5 of FIG. 1. It shows shaft 20 having eight substantially flat longitudinal shaft sides 29*a*–29*h* and eight substantially equiangular shaft corners 24*a*–24*h* therebetween. First shaft side 29*a* is an impact-alignment surface. Second shaft side 29*g* is a target-alignment surface. Shaft 20 inserts into chamber 45 down to butt 22 such that first shaft side 29*a* fittingly and effortlessly adjoins first chamber side 48*a* and second shaft side 29*g* fittingly, and with equal ease, adjoins second chamber side 48*g* thereby facilitating the mounting process and simultaneously maintaining impact-alignment and target-alignment integrity.

FIG. 6 is a cross-section view taken at line 6—6 of FIG. 1 (shaft 20 not shown for ease of explanation). It shows connector 34 having eight substantially flat inner connector sides 38*a*–38*h* with eight substantially equiangular inner connector corners 36*a*–36*h* therebetween, and eight substantially flat outer connector sides 39*a*–39*h* with eight substantially equiangular outer connector corners 37*a* –37*h* therebetween. First inner connector side 38*a* is an impact-alignment surface, whereas second inner connector side 38*g* is a target-alignment surface. First outer connector side 39*a* is an impact-alignment surface, whereas second outer connector side 39*g* is a target-alignment surface. Shaft 20 connects into connector 34 at tip 26 such that first shaft side 29*a* at tip 26 adjoins first inner connector side 38*a* in impact-alignment orientation and second shaft side 29*g* at tip 26 adjoins second inner connector side 38*g* in target-alignment orientation. In this mounting configuration, first outer connector side 39*a* is in impact-alignment orientation with all impact-alignment surfaces. Second outer connector side 39*g* is in target-alignment orientation with all target-alignment surfaces.

Shaft 20 may also connect at tip 26 over connector 34 such that first shaft side 29*a* fittingly adjoins first outer connector side 39*a* in impact-alignment orientation and second shaft side 29*g* fittingly adjoins second outer connecter side 39*g* in target-alignment orientation.

In this, the preferred embodiment, shaft 20 has eight substantially flat longitudinal shaft sides 29*a–h* running the full length of shaft 20 with eight substantially equiangular shaft corners 28*a–h* therebetween. Connector 34 has eight substantially flat inner 38*a–h* and outer connector sides 39*a–h* each with eight substantially equiangular connector corners 36*a–h*, 37*a–h*, respectively, therebetween. Shaft 20 connects thereat in perfect impact-alignment and target-alignment. Grip 40 has eight substantially flat longitudinal grip sides 49*a–h* running the full length of grip 40 with eight corners 47*a–h* therebetween. Chamber 45 has eight substantially flat longitudinal chamber sides 48*a–h* with eight substantially equiangular chamber corners 46*a–h* therebetween running the full length of chamber 45. First shaft side 29*a*, first grip side 49*a*, first chamber side 48*a*, first inner connector side 38*a*, and first outer connector side 39*a* are impact-alignment surfaces. Second shaft side 29*a*, second grip side 49*a*, second chamber side 48*a*, second inner connector side 38*a*, and second outer connector side 39*a* are target-alignment surfaces. Shaft 20 attaches thereat in perfect impact-alignment and target-alignment. All impact-alignment surfaces lie along one plane and all target-alignment surfaces lie along another plane. All impact-alignment surfaces are perpendicular to striking face 34 while all target-alignment surfaces are parallel to striking face 34.

Another embodiment may include more or less than eight mating sides. In such cases, there must be first shaft side 29*a*, first grip side 49*a*, first chamber side 48*a*, first inner connector side 38*a*, and first outer connector side 39*a* all of which are impact-alignment surfaces. There also must be second shaft side 29*a*, second grip side 49*a*, second chamber side 48*a*, second inner connector side 38*a*, and second outer connector side 39*a* all of which are target-alignment surfaces. In this embodiment, when head 30 and grip 40 are mounted to shaft 20 all impact-alignment surfaces lie along one plane and all target-alignment surfaces lie along another plane. All impact-alignment surfaces are perpendicular to striking face 34 while all target-alignment surfaces are parallel to striking face 34.

Yet another embodiment may include a plurality of quadrantally divisible substantially flat chamber sides (i.e., divisible by four), with first chamber side 48*a* being an impact-alignment surface and second chamber side 48*g* being a target-alignment surface. In this emmbodiment there are corresponding shaft sides and surfaces, and connector sides and surfaces such that, when head 30 and grip 40 are mounted to shaft 20 all impact-alignment surfaces lie along one plane and all target-alignment surfaces lie along another plane. All impact-alignment surfaces are perpendicular to striking face 34 while all target-alignment surfaces are parallel to striking face 34.

FIGS. 4*a* and 6*a*, taken on lines 4*a*—4*a* and 6*a*—6*a*, respectively, of FIG. 1, show still another embodiment of a mounting means for head 30 to shaft 20 and grip 40 to shaft 20. In FIG. 4*a*, shaft 20 is inserted into chamber 45 of grip 40. The registration of proper alignment is accomplished by at least one substantially straight shaft butt indentation 23*a* running along shaft 20 upward from butt 22 to top 14 of putter 10 (not shown; see FIG. 1). Shaft butt projection 21*a* complements a single shaft butt indentation. Chamber projection 41*a* cooperates with shaft butt indentation 23*a* for alignment-oriented mounting of grip 40 to shaft 20. Second shaft butt indentation 23*b* may also be placed on shaft 20 in similar fashion. In such a case, second chamber projection 41*b* cooperates with second shaft butt indentation 23*b* for alignment-oriented mounting of grip 40 to shaft 20. Chamber indentations 43*a*, 43*b* cooperate with shaft butt projections 21*a*, 21*b* at butt 22. Any number of shaft butt indentations and projections on shaft 20 with cooperating indentations and projections in chamber 45 may also be included.

FIG. 5*a* taken on line 5*a*—5*a* of FIG. 1 shows that shaft 20, below butt 22 and above tip 26, is substantially circular. In this embodiment, the mounting-alignment means may be any combination of substantially flat longitudinal sides or projections and indentations in chamber 45, butt 26, tip 22, and connector 34. The respective substantially flat longitudinal sides each must have an impact-alignment surface and a target-alignment surface.

FIG. 6*a* taken on line 6*a*—6*a* of FIG. 1 shows connector 34 having at least one connector projection 31*a* which cooperates with at least one shaft tip indentation 27*a* at shaft tip 26 for alignment-oriented mounting of head 30 to shaft 20. Second shaft tip indentation 27*b* at shaft tip 26 may also be placed on shaft 20 in similar fashion. In such a case, second connector projection 31*b* cooperates with second shaft tip indentation 27*b* for alignment-oriented mounted of head 30 to shaft 20. Connector indentations 33*a*, 33*b* cooperate with shaft tip projections 25*a*, 25*b* at shaft tip 26. Any number of shaft tip indentations and projections on shaft 20 with cooperating indentations and projections in connector 34 may also be included.

The projections and indentations in all cases may be substantially straight and may be configured in any fashion including, but not limited to, slots and ribs, lands and grooves, channels and elevated members, and the like; and may be substantially squared, substantially angled, or substantially curved. Regardless of the specific configuration, the projections and indentations must fittingly correspond and cooperate with one another such that the mounting-alignment process is facilitated and impact-alignment and target-alignment integrity is maintained.

While specific embodiments of an improved golf putter have been shown and fully explained above for the purpose of illustration, it should be understood that many other uses will be found for the instant invention disclosure and many alterations, modifications, and substitutions may be made thereto without departing from the spirit and scope of the invention as defined by the appended claims. Such are intended to be included within the scope of the invention. The concept of this invention relates equally to all types of golf clubs, not specifically to a putter, and to all types of sporting implements which require accuracy in mounting and in play. Accordingly, the scope of the invention should be determined not by the embodiments illustrated, but by the appended claims and their legal equivalents.

The invention claimed is:

1. A golf club comprising;

a grip having an outer grip surface and a chamber;

a shaft having a butt and a tip;

a head having a connector and a striking face;

said grip positioned on said butt and said head positioned on said tip each of said shaft, said grip and said head each having an impact-alignment surface and a target-alignment surface;

mounting-alignment means carried by said grip, said head, and said shaft for only allowing registration of said respective impact-alignment surfaces and said target-alignment surfaces of said grip and said head along the same plane whereby said grip, said head, and said shaft can only be assembled when aligned by said mounting-alignment means;

said mounting-alignment means comprising a plurality of substantially flat longitudinal shaft sides on said shaft with a first shaft side being an impact-alignment surface and a second shaft side being a target-alignment surface, a connector on said head, said connector having a plurality of connector sides with a first connector side being an impact-alignment surface and a second connector side being a target-alignment surface, a plurality of substantially flat longitudinal chamber sides in said chamber with a first chamber side being an impact-alignment side and a second chamber side being a target-alignment side such that when said head and said grip are mounted to said shaft, all impact-alignment surfaces align along the same plane in an operational substantially parallel relationship with one another and in a substantially perpendicular relationship with said striking face, all target-alignment surfaces align along the same plane in an operational substantially parallel relationship with one another and in a substantially parallel relationship with said striking face and substantially perpendicular with all impact-alignment surfaces; and attachment means for attaching said grip to said head and said head to said shaft only when said grip and said head respective impact-alignment surfaces and target-alignment surfaces are in alignment.

2. The invention as defined in claim 1 wherein said outer grip surface further has a plurality of grip sides with a first grip side being an impact-alignment surface and a second grip side being a target-alignment surface.

3. The invention as defined in claim 1 wherein said outer grip surface further has a plurality of quadrantally divisible grip sides with a first grip side being an impact-alignment surface and a second grip side being a target-alignment surface.

4. The invention as defined in claim 1 wherein said chamber further has a plurality of chamber sides with a first chamber side being an impact-alignment surface and a second chamber side being a target-alignment surface.

5. The invention as defined in claim 1 wherein said chamber further has a plurality of quadrantally divisible chamber sides with a first chamber side being an impact-alignment surface and a second chamber side being a target-alignment surface.

6. The invention as defined in claim 1 wherein said shaft further has a plurality of shaft sides with a first shaft side being an impact-alignment surface and a second shaft side being a target-alignment surface.

7. The invention as defined in claim 1 wherein said shaft further has a plurality of quadrantally divisible shaft sides with a first shaft side being an impact-alignment surface and a second shaft side being a target-alignment surface.

8. The invention as defined in claim 1 wherein said connector further has a plurality of connector sides with a first connector side being an impact-alignment surface and a second connector side being a target-alignment surface.

9. The invention as defined in claim 1 wherein said connector further has a plurality of quadrantally divisible connector sides with a first connector side being an impact-alignment surface and a second connector side being a target-alignment surface.

10. The invention as defined in claim 1 wherein said attachment means comprises an adhesive selected from a group consisting of tape and epoxy.

11. The invention as defined in claim 1 wherein said attachment means comprises friction-fitting.

12. The invention as defined in claim 1 wherein said mounting-alignment means comprises a plurality of quadrantally divisible substantially flat longitudinal shaft sides on said shaft having equiangular shaft corners therebetween with a first shaft side being an impact-alignment surface and a second shaft side being a target-alignment surface, a connector on said head, said connector having a plurality of quadrantally divisible connector sides with equiangular connector corners therebetween with a first connector side being an impact-alignment surface and a second connector side being a target-alignment surface, a plurality of quadrantally divisible substantially flat longitudinal chamber sides in said chamber having equiangular chamber corners therebetween with a first chamber side being an impact-alignment surface and a second chamber side being a target-alignment surface such that when said head and said grip are mounted to said shaft, all impact-alignment surfaces align along the same plane in an operational substantially parallel relationship with one another and in a substantially perpendicular relationship with said striking face, all target-alignment surfaces align along the same plane in an operational substantially parallel relationship with one another and in a substantially parallel relationship with said striking face and substantially perpendicular with all impact-alignment surfaces.

13. A golf club comprising;

a grip having an outer grip surface and a chamber;

a shaft having a butt and a tip;

a head having a connector and a striking face;

said grip positioned on said butt and said head positioned on said tip each of said shaft, said grip and said head each having an impact-alignment surface and a target alignment surface;

mounting-alignment means carried by said grip, said head, and said shaft for only allowing registration of said respective impact-alignment surfaces and said target-alignment surfaces of said grip and said head along the same plane whereby said grip, said head, and said shaft can only be assembled when aligned by said mounting-alignment means;

said mounting-alignment means comprising at least one shaft tip indentation on said tip and at least one corresponding connector projection on said connector for mounting said head to said tip, and at least one shaft butt indentation on said butt and at least one chamber projection in said chamber for mounting said grip to said butt, such that when said head is mounted to said shaft all impact-alignment surfaces align along the same plane in an operational substantially parallel relationship with one another and in a substantially perpendicular relationship with said striking face, all target-alignment surfaces align along the same plane in an operational substantially parallel relationship with one another and in a substantially parallel relationship with said striking face and substantially perpendicular with all impact-alignment surfaces; and attachment means for attaching said grip to said head and said head to said shaft only when said grip and said head respective impact-alignment surfaces and target, alignment surfaces are in alignment.

14. A golf club comprising:

a shaft having a butt, a tip, and eight substantially flat longitudinal shaft sides having substantially equiangular shaft corners therebetween with a first shaft side being an impact-alignment surface and a second shaft side being a target-alignment surface;

a head connected to said tip of said shaft, said head having a striking face and a connector to connect said shaft, said connector having eight substantially flat connector sides with eight equiangular connector corners therebetween with a first connector side being an impact-alignment surface and a second inner connector side being a target-alignment surface; and a grip attached to said butt of said shaft, said grip further having an outer grip surface and a chamber, said chamber having therein eight substantially flat longitudinal chamber sides with eight equiangular chamber corners therebetween, said chamber sides corresponding with said shaft sides at said butt wherein a first chamber side is an impact-alignment surface and a second chamber side is a target-alignment surface, said outer grip surface further having eight substantially flat longitudinal grip sides wherein a first grip side is an impact-alignment surface and a second grip side is a target-alignment surface, such that when said head and said grip are connected to said shaft all impact-alignment surfaces align along the same plane in an operational substantially parallel relationship with one another and in a substantially perpendicular relationship with said striking face, all target-alignment surfaces align along the same plane in an operational substantially parallel relationship with one another and in a substantially parallel relationship with said striking face and substantially perpendicular with all impact-alignment surfaces.

15. A golf club having a top and a bottom, said club comprising:

a shaft having a butt and a tip, said shaft further having at least one substantially straight shaft butt indentation at said butt running longitudinally along said shaft from said butt to said top, and at least one substantially straight shaft tip indentation at said tip running longitudinally along said shaft at said tip toward said bottom;

a head connected to said tip of said shaft, said head having a striking face and a connector into which said shaft is connected, said connector having at least one substantially straight connector projection thereat, said connector projection fittingly corresponding with said shaft tip indentation at said tip;

a grip attached to said butt of said shaft, said grip further having an outer grip surface and a chamber, said chamber having at least one substantially straight chamber projection therein, said chamber projection fittingly corresponding with said shaft butt indentation at said butt, said outer grip surface further having eight substantially flat longitudinal grip sides where a first grip side is an impact-alignment surface and a second grip side is a target-alignment surface, such that when said head and said grip are connected to said shaft all impact-alignment surfaces align along the same plane in an operational substantially parallel relationship with one another and in a substantially perpendicular relationship with said striking face, all target-alignment surfaces align along the same plane in an operational substantially parallel relationship with one another and in a substantially parallel relationship with said striking face and substantially perpendicular with all impact-alignment surfaces.

* * * * *